United States Patent [19]

Hirano

[11] Patent Number: 4,483,231

[45] Date of Patent: Nov. 20, 1984

[54] PRESET APPARATUS OF ELECTRONIC MUSICAL INSTRUMENT

[75] Inventor: Katsuhiko Hirano, Shizuoka, Japan

[73] Assignee: Nippon Gakki Seizo Kabushiki Kaisha, Japan

[21] Appl. No.: 431,890

[22] Filed: Sep. 30, 1982

[30] Foreign Application Priority Data

Oct. 5, 1981 [JP] Japan ..... 56-148468[U]

[51] Int. Cl.[3] ..... G10H 1/02

[52] U.S. Cl. ..... 84/1.19; 84/345

[58] Field of Search ..... 84/1.19, 1.24, 345, 84/115, 1.01, 1.03

[56] References Cited

U.S. PATENT DOCUMENTS 4,244,264 1/1981 Fellot ..... 84/345

4,391,176 7/1983 Niinomi et al. ..... 84/1.19

4,402,246 9/1983 Sekiguchi ..... 84/1.19

*Primary Examiner*—Forester W. Isen

*Attorney, Agent, or Firm*—Remy J. VanOphem

[57] ABSTRACT

Various types of information utilized for performance of an electronic musical instrument are stored in first and second memories. The information stored in the first memory represents parameters, as a preset data set, which determine a characteristic of a musical tone to be produced. The information stored in the second memory is auxiliary data representing information other than the parameters such as performance messages. The auxiliary data used in combination with the preset data set are stored in the second memory through auxiliary data input means, such as keys of the electronic musical instrument, and are read out of the second memory to be displayed on the display means.

8 Claims, 7 Drawing Figures

PRESET APPARATUS OF ELECTRONIC MUSICAL INSTRUMENT

BACKGROUND OF THE INVENTION

This invention relates to a present apparatus of an electronic musical instrument.

A prior art electronic musical instrument such as a musical synthesizer is often provided with a preset apparatus in which various parameters for generating musical tones such as the waveform of a musical tone and the waveform of a tone volume envelope are set by a player as preset data and stored in a memory device. Thereafter, at another time, the stored data are read out from the memory device for producing musical tones. An example of such an instrument is disclosed in U.S. Pat. No. 3,926,087 issued on Dec. 16, 1975.

In the prior art preset apparatus, however, the data stored in the memory device are only the parameters for generating musical tones. Therefore, factors which were felt by the player at the time of storing the parameters in the memory device, for example an optimum keyboard tone range for a tone color, especially a specific performance mode manifesting a musical effect, would be lost. For this reason even when the preset data are read out from the memory device for effecting a performance it is difficult to reproduce, at a high fidelity, the performance tone at the time of presetting.

SUMMARY OF THE INVENTION

It is, therefore, an object of this invention to provide a novel preset apparatus of an electronic musical instrument capable of reproducing, at a high fidelity, the performance tone at the time of storing preset data even when they are read out for effecting a performance, a long time after storing the preset data.

To accomplish this and other objects, according to the preset apparatus of this invention, the preset data are stored in a memory device together with auxiliary data representing such a performance message as a tone color, a modulation effect and a keyboard note range optimum to the preset data, and at the time of reproduction the auxiliary data are displayed to a performer.

Preset apparatus according to the invention includes, in one aspect, parameter setting means including a plurality of parameter setting members for setting parameters which determine a characteristic of a musical tone to be produced, first memory means for storing the parameters as a preset data set, auxiliary data input means for inputting auxiliary data representing information other than the parameters and to be used in combination with the preset data set, second memory means for storing the auxiliary data, preset switch means for selectively designating storage portions of the first and second memory means, control means for controlling writing and reading of the preset data set and the auxiliary data into and out of the storage positions of the first and second memory means designated by the preset switch means, and display means for displaying the auxiliary data read out of the second memory means.

DETAILED DESCRIPTION OF THE PREFERRED EMBODIMENT

In the following embodiment, the invention will be described as applied to preset apparatus of a music synthesizer.

Figure 1:
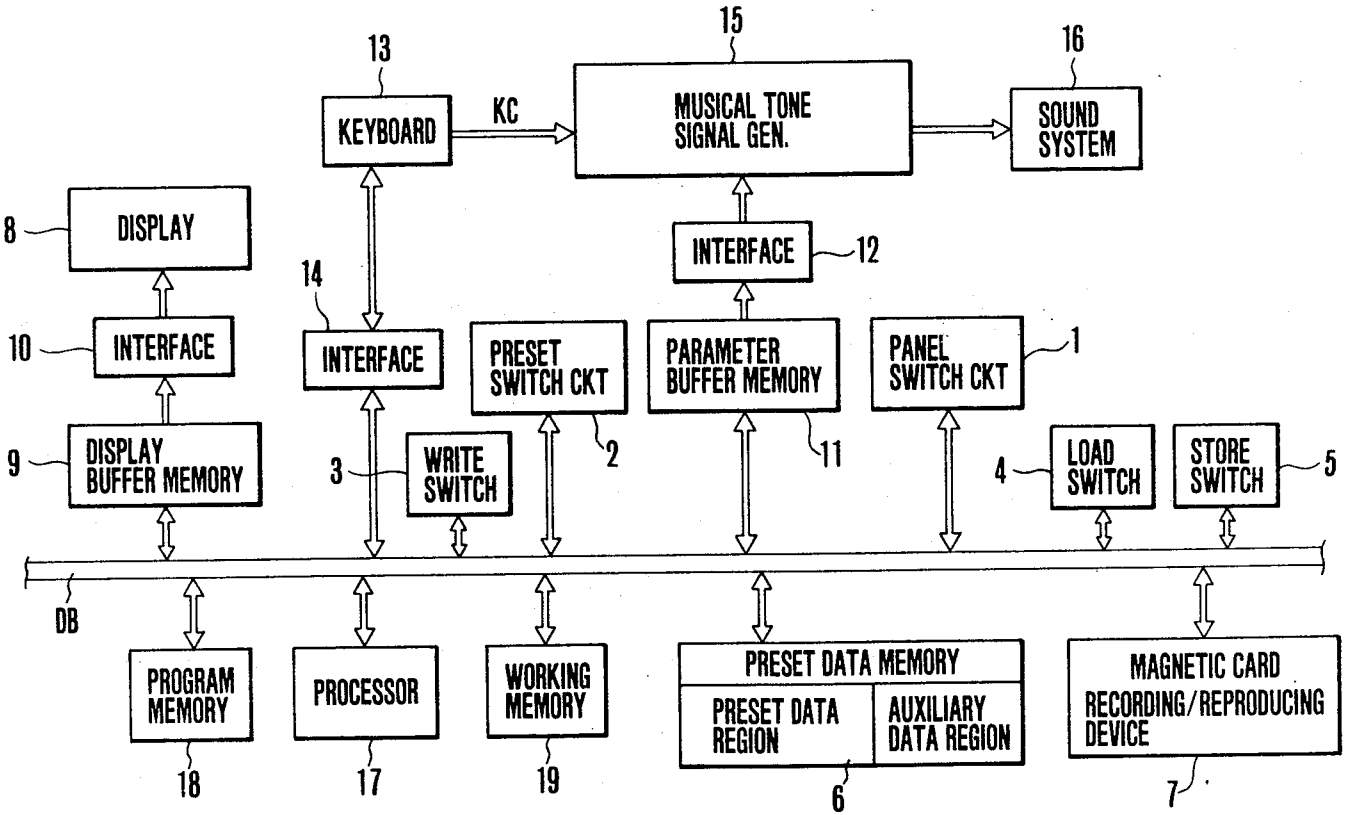
FIG. 1 is a block diagram showing one embodiment of an electronic musical instrument embodying the invention.
Figure 2:
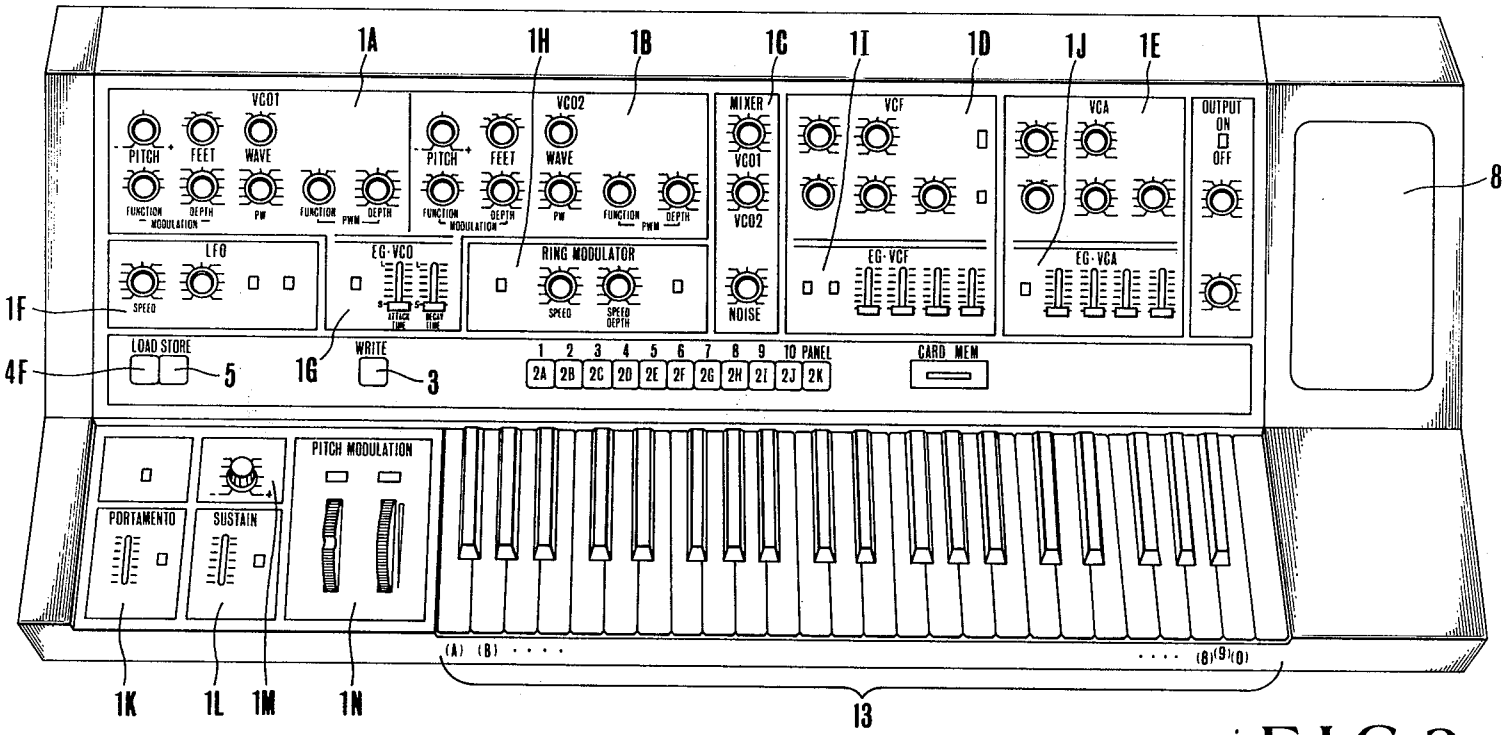
FIG. 2 is a perspective view showing one example of an operating panel.

The musical instrument shown in FIG. 1 includes a panel switch circuit 1 having a plurality of parameter setters in the form of slide or rotary type volume adjusting resistors as shown by reference characters 1A through 1N in FIG. 2. The parameter setters are used to set such various parameters for producing musical tones, each of which serves to determine a characteristic of a musical tone to be produced, such as the frequency and waveform of a voltage controlled type variable frequency oscillator (VCO), the cut-off frequency of a voltage controlled type filter (VCF), and an attack or decay of an amplitude envelope. Analog parameters set by the parameter setters are converted into digital signals by an A/D converter, not shown, and then stored in a preset data memory device 6 to be described later.

A preset switch circuit 2 is provided for designating address positions of the preset data memory device 6 in which groups of parameters each including a set of various parameters are stored as the preset data, or the address positions from which the preset data already stored in the preset data memory device 6 are to be read out. In this embodiment, as shown by reference characters 2A through 2J, there are provided ten switches and a switch 2K for controlling effectiveness of these ten switches.

There are also provided a write switch 3 for designating writing of the parameters set by the panel switch circuit 1 in addresses of the preset data memory device 6 designated by the preset switch circuit 2, a load switch 4 for reading out preset data stored in an external memory device, e.g., a magnetic card, and a store switch 5 for reading out preset data stored in addresses designated by the preset switch circuit 2, among a plurality of sets of preset data stored in the preset data memory device 6 and then storing the read out data in an external memory device, e.g., a magnetic card. The write switch 3, the load switch 4 and the store switch 5 are provided on the left-hand side of the operating panel shown in FIG. 2.

The preset data memory device 6 stores the preset data set by the panel switch circuit 1 as well as auxiliary data to be displayed on a display device 8 to be described later. The auxiliary data do not determine a characteristic of a musical tone but represent a performance message which is useful to the performer. The memory region of the preset data memory device 6 is divided into a preset data region and an auxiliary data region, the preset data region being subdivided into ten memory regions corresponding to the ten preset switches 2A through 2J.

For the purpose of storing or reading preset data into and out of the magnetic card, that is the external memory device, a magnetic card recording/reproducing device 7 is provided. In this embodiment, preset data are recorded on the magnetic card together with the auxiliary data indicative of a performance message. The auxiliary data are read out by the operation of the load switch 4 and stored in the auxiliary region of the preset data memory device 6.

Figure 3:
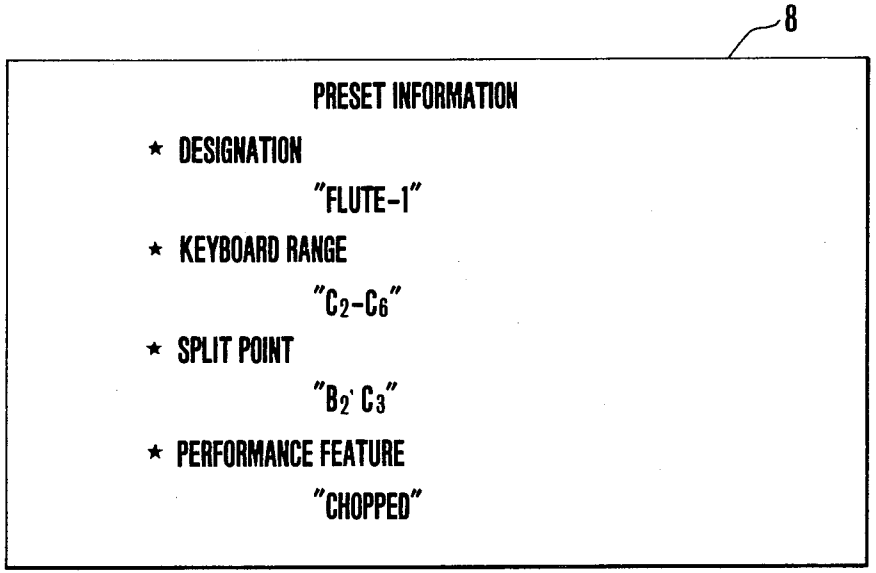
FIG. 3 is an elevational view showing one example of a performance message displayed by a display device.

The display device 8 is used to display the contents of the auxiliary data stored in the auxiliary data region of the preset data memory device 6. In this example, a plurality of letter display elements such as liquid crystal panels are arranged on the surface of the display device 8 for displaying the auxiliary data with words as shown in FIG. 3. The display device 8 is disposed on the right-hand end of the operating panel shown in FIG. 2. The auxiliary data displayed on the display device 8 are read out from the auxiliary data region of the preset data memory device 6 and supplied to the display device 8 via a display buffer memory device 9 and an interface 10.

A parameter buffer memory device 11 is provided for temporarily storing a plurality of parameters set by the panel switch circuit 1 or a plurality of parameters read out from the preset data memory device 6 as a preset data set. Each of the preset data sets temporarily stored in the parameter buffer memory device 11 is applied to a musical tone signal generator 15, to be described later, via an interface 12 to act as parameters for producing the musical tone.

A keyboard 13, having a plurality of keys, produces key data KC representing depressed keys which are operated in a performance mode in which the write switch 3 is not operated. When keys are depressed in a preset mode in which the write switch 3 is operated, the keyboard 13 outputs the auxiliary data, that is the performance message, previously assigned to selected keys. More particularly, the selected keys are preassigned with operations to input auxiliary data as shown in the following Table I. When key E2, for example, is depressed in a preset mode, auxiliary data representing the tone color of "FLUTE-1" is output. The auxiliary data thus applied are stored in the auxiliary data region of the preset data memory device 6 via an interface 14.

TABLE I

| Key | Auxiliary data |
|---|---|
| $C_2$ | |
| . | |
| . | |
| . | |
| $E_2$ | FLUTE-1 |
| $F_2$ | FLUTE-2 |
| $F\#_2$ | JAZZ FLUTE |
| $G_2$ | CLARINET |
| . | |
| . | |
| $A_3$ | TRUMPET-1 |
| . | |
| . | |
| . | |
| $C_6$ | MUTED W/SLOW VIB |
| $C\#_6$ | CHOPPED |
| $D_6$ | HARD MALLET |
| $D\#_6$ | PITCH MOD/SLOW |
| $E_6$ | DEEP MOD |
| . | |
| $C_7$ | RETURN |

In Table I, "FLUTE-1" through "TRUMPET -1" represents respective tone color names. "MUTED W/SLOW VIB" represents a moderate tone imparted with a slow vibrate, "CHOPPED" represents a tone produced by striking strings of a guitar, and "HARD MALLET" represents a tone having a feeling of a tone produced by striking a glockenspiel or a xylophone with a mallet. Furthermore "RETURN" represents that the input of auxiliary data has been completed.

The musical tone signal generator 15 forms a musical tone signal corresponding to the preset data set supplied from the parameter buffer memory device 11, and key data KC output from the keyboard 13. The musical tone signal from the musical tone signal generator 15 is sent to a sound system 16 to produce a musical tone.

A processor 17 is provided for controlling the storing of the preset data sets set by the panel switch circuit 1, storing of the auxiliary data input from the keyboard 13, and reading out of the preset data set and auxiliary data stored in the preset data memory device 6. The processing operations of the processor 17 are executed according to a program prestored in a program memory device 18. Writing and reading out of various data are performed through a data bus line DB of the processor 17. To this end, the panel switch circuit 1, the preset switch circuit 2, the write switch 3, the load switch 4, the store switch 5, preset the memory device 6, the magnetic card recording/reproducing device 7, the display buffer memory device 9, the parameter buffer memory device 11, the interface 14, and the program memory device 18 are all connected to the data bus line DB. A working memory device 19 is also connected to the data bus line DB for temporarily storing intermediate results of various processings executed by the processor 17.

The operation of the electronic musical instrument having a construction as described above will now be described with reference to the flow charts shown in FIGS. 3, 4 and 5.

The operating modes of the electronic musical instrument include:

A. A preset performance mode in which the preset switch 2K is turned ON, the write switch 3 is turned OFF, either one of the preset switches 2A through 2J is turned ON, the preset data set designated by the turned ON preset switch is read out from the preset data memory device 6, and a musical tone is performed corresponding to the read out preset data set, B. A panel performance mode, in which the preset switch 2K and the write switch 3 are turned OFF, for performing a musical tone corresponding to a parameter set by the panel switch circuit 1, and C. A preset mode in which preset switch 2K and either one of the preset switches 2A through 2J are turned ON, and the write switch 3 is turned ON so as to write, as a preset data set, parameters set by the panel switch circuit 1 and, as a performance message, the auxiliary data input by utilizing the keys of the keyboard 13 into the preset data memory device 6.

Figure 4:
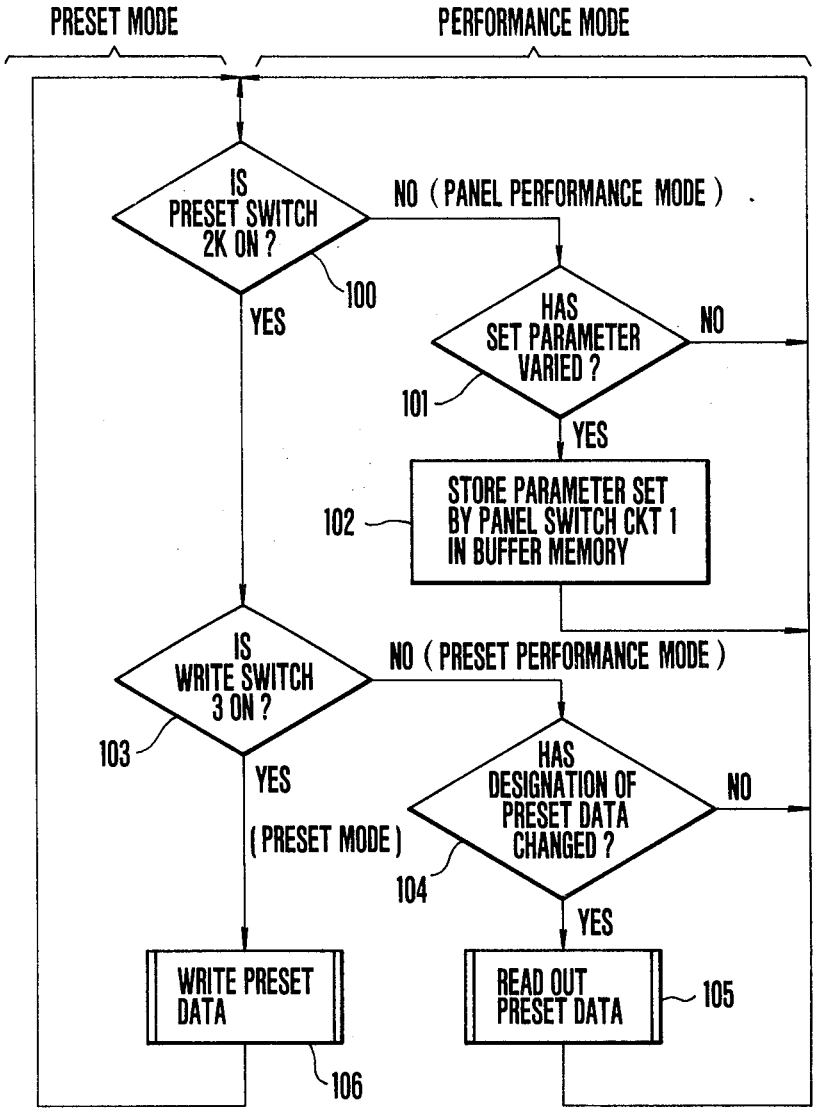
FIGS. 4 through 6 are flow charts for explaining the operation of this invention.

As shown by step 100 of the flow chart shown in FIG. 4, for the purpose of judging that the operation mode is in either one of the three modes, the processor 17 checks whether the preset switch 2K is turned ON. When the switch 2K is OFF, it is judged that the present mode is set in the panel performance mode so that the parameters, that is the data set by the panel switch circuit 1, are transferred to the working memory device 19. Then the parameters transferred to the working memory device 19 are compared with parameters already stored in the parameter buffer memory device 11. When the compared parameters do not coincide with each other, at step 101, it is judged that the parameters set by the panel switch circuit 1 have changed. The processor 12 than stores the parameters presently set by the panel switch circuit 1 in the parameter buffer memory device 11, as indicated at step 102. In other words, since the newest parameters are temporarily stored in the working memory device 19, the content thereof is transferred to the parameter buffer memory device 11. However, when the parameters stored in the parameter buffer memory device 11 coincide with the parameters now being set by the panel switch circuit 1, it is judged that the setting of the parameters is not changed and the processing is returned to step 100 from step 101 for repeating the same processings. As a result, the newest parameters set by the panel switch circuit 1 would be stored in the parameter buffer memory device 11. The parameters stored in the parameter buffer memory device 11 are supplied to the musical tone signal generator 15 via the interface 12. Accordingly, when keys of the keyboard 13 are depressed under this state, the musical tone signal generator 15 generates a musical tone signal having a tone pitch of the depressed key and a tone color corresponding to the parameter based on the key data KC corresponding to the depressed key and the parameters stored in the parameter buffer memory device 11. The sound signal is produced as a musical tone by the sound system 16.

When the result of judgment made at step 100 shows that the preset switch 2K is turned ON, the processing is advanced to step 103 to judge whether the write switch 3 has been turned ON or not. When the result of judgment shows that the write switch 3 is OFF, it is judged that the operating mode is the preset performance mode in which one of a plurality of sets of the preset data stored in the preset data memory device 6 is used for the performance. Then, at step 104, whether the designation of the preset data by the preset switches 2A through 2J has changed or not is judged. If the designation has changed, at step 105, the preset data designated by the preset switches 2A through 2J are read out. Conversely, if the designation of the preset data did not change, the processing returns to step 100. Thereafter, the operation of step 103, step 104, step 100 and step 103 is repeated. In this case, where the designation of the preset data has not changed, the preset data set designated by the preset switches 2A through 2J are read out from the preset data region of the preset data memory device 6 and stored in the parameter buffer memory device 11.

Where the designation of the preset data has changed, the preset data set now being designated by the preset switches 2A through 2J is read out from the preset data memory device 6 and stored in the parameter buffer memory device 11. As a consequence, a set of preset data corresponding to the newest operating states of the preset switches 2A through 2J is stored in the parameter buffer memory device 11. As a result, when a key of the keyboard 13 is depressed under this state, based on a key data KC corresponding to the depressed key and on the preset data including sets of a plurality of parameters stored in the parameter buffer memory device 11, the musical tone signal generator 15 generates a musical tone signal corresponding to the tone pitch of the depressed key and having a tone color corresponding to the preset data. The musical tone signal is produced as a musical tone by the sound system 16.

The preset data memory device 6 stores the preset data together with the auxiliary data shown in Table I, including the optimum keyboard tone range where a musical tone is to be produced based on the preset data. Accordingly, when reading out the preset data, the preset data set designated by the preset switches 2A through 2J are read out together with the auxiliary data. The auxiliary data are temporarily stored in the display buffer memory device 9 and then supplied to the display device 8 via the interface 10 whereby the display device 8 displays the auxiliary data as shown in FIG. 3. Thus, when the performer performs a musical performance according to the displayed content, a performance tone the same as that at the time of recording the preset data can be produced.

Based on the result of the judgment made at step 103, when the processor 17 judges that the write switch 3 is ON, it is judged that the operating mode is the preset mode to commence the preset data writing process. At step 106 a plurality of parameters set by the panel switch circuit 1 are written in the preset data region of the preset data memory device 6 as the preset data set, and the auxiliary data inputted by utilizing the key of the keyboard 13 are written into the auxiliary data region of the preset data memory device 6 as the performance message.

Figure 5:
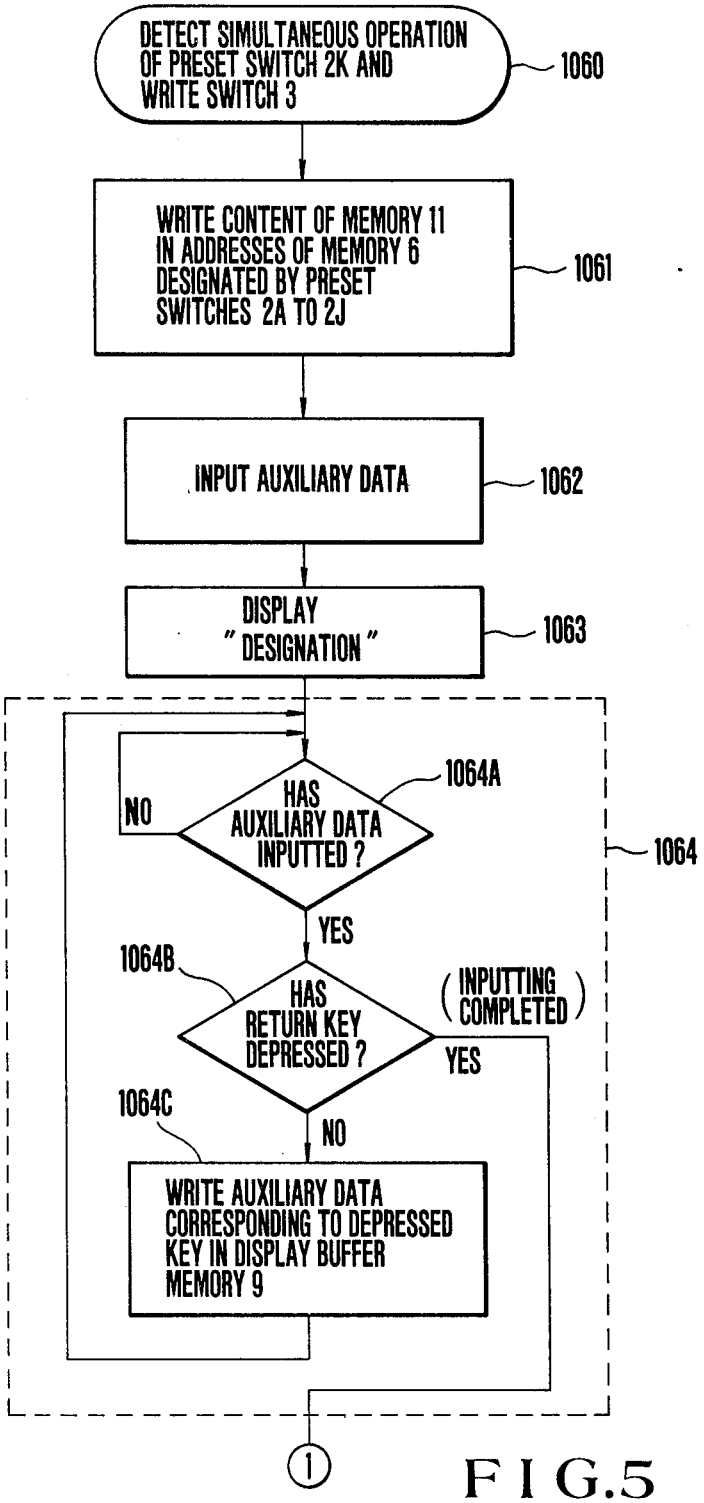

More particularly, at step 1060, shown in FIG. 5 when simultaneous operation of the preset switch 2K and write switch 3 is detected, a plurality of parameters set by the panel switch circuit 1 are written into the addresses of the preset data memory device 6 which are designated by the preset switches 2A through 2J. In this case, the preset data to be stored in the preset data memory device 6 correspond to a desired tone color obtained by generating several times, musical tones based on a plurality of parameters set by the panel switch circuit 1. These preset data are initially stored in the parameter buffer memory device 11. Accordingly, the processor 17 reads out the data to be preset from the parameter buffer memory device 11 and writes the read out data in designated addresses of the preset memory device 6, at step 1061. Thereafter, at step 1062, input of the auxiliary data is started.

Figure 6:
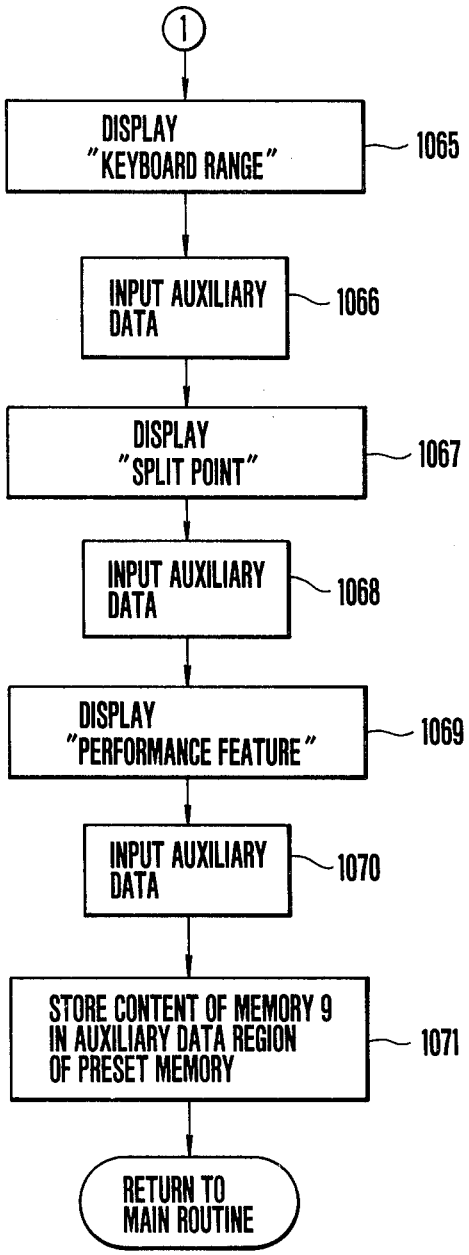

As shown by step 1063, during the input processing of the auxiliary data, a fixed display word "DESIGNATION" is displayed on the display device 8. Then, at step 1064A a waiting state inputting operation of auxiliary data is started to successively input the auxiliary data to the display buffer memory device 9 by utilizing the key of the keyboard 13. When key $E_2$, for example, is depressed, as can be noted from Table I, auxiliary data corresponding to a word "FLUTE-1" are output from the keyboard 13. These auxiliary data are transferred to the display buffer memory device 9 and stored therein via the interface 14, at step 1064C. At this time, the auxiliary data "FLUTE-1" are supplied to the display device 8 via the interface 10. Thereafter, when a key $C_7$, acting as a "RETURN" key indicating the termination of the input of auxiliary data, is depressed, at step 1064B, input of auxiliary data "DESIGNATION" is completed and the program is advanced to step 1065 shown in FIG. 6. At step 1065, after displaying the fixed word "KEYBOARD RANGE" on the display device 8 the program advances to step 1066, when auxiliary data are again input to the display buffer memory 9. The processing executed at step 1066 is similar to that of step 1064. When keys $C_2$ and $C_6$, for example, are depressed at step 1066, auxiliary data showing that a key range of $C_2$ through $C_6$ is the optimum key range, are output from the keyboard 13 and stored in the display memory device 9. When key $C_7$ is depressed, the processor 17 judges that input of auxiliary data the concerning "KEYBOARD RANGE" has been completed and advances to the next step 1067 at which fixed display words "SPLIT POINT" are displayed on the display device 8. Then, the processing is advanced to step 1068 at which the auxiliary data are input. This step is similar to step 1064, described above. Auxiliary data representing that a key range splitting point between depressed keys $B_2$ and $C_2$, for example lies between the keys $B_2$ and $C_3$ are output from the keyboard 13 and is then stored in the display buffer memory device 9.

Then, when key $C_7$ is operated, the processor 17 judges that the input of auxiliary data concerning the "SPLIT POINT" has been completed. At the next step 1069 fixed display words "PERFORMANCE FEATURE" are displayed on the display device 8 and then at the next step 1070, auxiliary data are inputted. The processing at step 1070 is similar to that of step 1064 described above and at step 1070, when a key C#6, for example, is depressed, auxiliary data corresponding to a word "CHOPPED" are output from the keyboard 13 and stored in the display buffer memory device 9. As described above, when the input process of a number of auxiliary data is complete, all auxiliary data stored in the display buffer memory device 9 are stored in addresses of the auxiliary data region of the preset data memory device 6 designated by switches 2A through 2J, and the execution of the program returns to the main routine shown in FIG. 4.

As described above, it is possible to store in the preset data memory device 6 desired preset data set by the panel switch circuit 1 and a performance memory information, indicative of an optimum keyboard tone range and a performance feeling, as the auxiliary data. Consequently, when a performance is made based on the preset data stored in the preset data memory device 6, and by referring to the display of the auxiliary data, a musical tone having a tone color similar to that obtained at the time of recording the preset data can be produced.

It is possible to store the preset data and the auxiliary data on a magnetic card set on the magnetic card recording/reproducing device 7 by operating the store switch 5. When the load switch 4 is operated it is possible to read the preset data and the auxiliary data stored in the magnetic card and to store the read out data in the parameter buffer memory device 11 and the display buffer memory device 9 so as to produce a musical tone having a desired tone color based on the contents of the memory devices 11 and 9 and to display the auxiliary data on the display device 8.

In the above described embodiment, all auxiliary data are displayed on the same display device. However, the auxiliary data may be displayed on independent display devices. Further, instead of assigning the auxiliary data to specific keys of the keyboard, one letter of the alphabet or one numeral can be assigned to each key as exemplified by indications at the front side of the keyboard 13 in FIG. 2. The desired auxiliary data may, thus, be obtained by a plurality of key operations as in a typewriter. Alternatively, an operating member exclusively used to input auxiliary data may be provided to obtained the desired auxiliary data.

As described above, in the preset apparatus of an electronic musical device embodying the invention, various accompaniment information at the time of storing preset data are stored in a memory device together with preset data as auxiliary data, and at the time of reading out the preset data, the auxiliary data are displayed to a performer. Accordingly, even when the prestored preset data are read out after a long time to make a performance, it is possible to reproduce, at a high fidelity the performance tone when the preset data were first stored.

Figure 7:
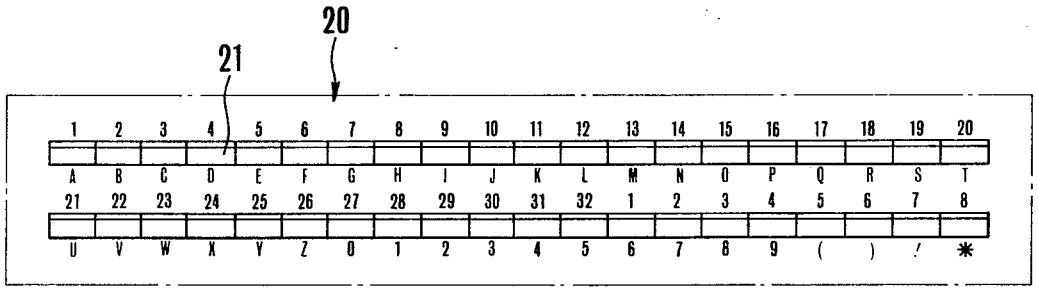
FIG. 7 is a partial diagrammatic view showing another example of the operating panel.

It should be understood that the invention is not limited to the specific embodiment described above and that many changes and modifications will be obvious to one skilled in the art without departing from the true spirit and scope of the invention as defined in the appended claims. For example, another auxiliary data input device is shown in FIG. 7. the auxiliary data input device 20 includes a plurality of switches 21 of a push button type which are arranged along two lines on an operating panel 22. Each of the switches 21 is assigned to one of alphabetical or numerical character, such as A, B, C, . . . Z, 1, 2, 3, . . . 0, . . . ', and * so that a performance message can be input by the performer as desired. The input device also functions as a preset switch device. Therefore, at a location above each of the switches 21, a label is used to indicate the alpha/numeric representation used for designating storage positions of the preset data memory device 6 where preset data sets and the corresponding auxiliary data are stored. Other components are similar to those of the apparatus shown in FIGS. 1 and 2.

In the preset performance mode, where the preset switch is ON and the write switch OFF, a preset data set and corresponding auxiliary data to be utilized are selected by depressing one of the preset switches 21. In the preset mode where both switches are ON, the preset switches 21 act as the auxiliary data input device 20. Therefore, when a preset switch is operated, an alphabetical character or a numerical character assigned to the operated preset switch is input to the auxiliary data region of the preset data memory device 6.

The auxiliary the data set may include date of the preset, location of preset, name of the musical instrument to be combined for performance, name of performer, and name of music performed by utilizing the preset parameter set. Where these auxiliary data can be used, in preset performance mode all auxiliary data stored in the preset data memory may be simultaneously displayed or segmentially displayed on the display device to find what the performer necessitates.

What is claimed is:

1. A preset apparatus of an electronic musical instrument comprising:

parameter setting means including a plurality of parameter setting members for setting parameters which determine a characteristic of a musical tone to be produced;

first memory means for storing said parameters as a preset data set;

auxiliary data input means for inputting auxiliary data representing information other than said parameters and to be used in combination with said preset data set;

second memory means for storing said auxiliary data;

preset switch means for selectively designating storage portions of said first and second memory means;

control means for controlling writing and reading of said preset data set and said auxiliary data into and out of said storage positions of said first and second memory means designated by said preset switch means; and display means for displaying said auxiliary data read out of said second memory means.

2. The preset apparatus according to claim 1, wherein said auxiliary data input means comprises a plurality of preset switches, at least one of alphabetical notation and numerical notation is assigned to each of said preset, switches, whereby, when one of said preset switches is operated in a writing mode, a character of the notation assigned to said operated preset switch is input to said second memory means under the control of said control means.

3. The preset apparatus according to claim 1 wherein said musical instrument includes a plurality of keys corresponding to respective musical notes, said plurality of keys further constitute said auxiliary data input means, and at least one of alphabetical notation and numerical notation is assigned to each of said keys, whereby, when one of said keys is operated in a writing mode, a character of the notation assigned to said operated key is input to said second memory means under the control of said control means.

4. The preset apparatus according to claim 1 wherein said musical instrument includes a plurality of keys corresponding to respective musical notes, said keys constitute said auxiliary data input means and performance messages constituting said auxiliary data are selectively assigned to predetermined keys, whereby, when one of said performance message assigned keys is operated, said performance message is input to said second memory means under the control of said control means.

5. The preset apparatus according to claim 1 which further comprises an external memory for storing said preset data set and said auxiliary data.

6. The preset apparatus according to claim 2 which further comprises an external memory for storing said preset data set and auxiliary data.

7. The preset apparatus according to claim 3 which further comprises an external memory for storing said preset data set and said auxiliary data.

8. The preset apparatus according to claim 4 which further comprises an external memory for storing said preset data set and said auxiliary data.

* * * * *

UNITED STATES PATENT AND TRADEMARK OFFICE

CERTIFICATE OF CORRECTION

PATENT NO. : 4,483,231

DATED : November 20, 1984

INVENTOR(S) : Katsuhiko Hirano

It is certified that error appears in the above-identified patent and that said Letters Patent is hereby corrected as shown below:

Column 4, line 22, delete "preset the" and insert ---- the preset ----.

Column 4, line 48, after "which" insert ---- the ----.

Column 6, line 38, after "preset" insert ---- data ----.

Column 7, line 9, delete "$C_2$" and insert ---- $C_3$ ----. Same line, delete "lies" and insert ---- lying ----.

Column 8, line 13, delete "the" and insert ---- The ----.

Column 8, line 39, before "preset" insert ---- the ----.

Column 10, line 16, after "and" insert ----said----.

Signed and Sealed this

Thirtieth Day of April 1985

[SEAL]

*Attest:*

DONALD J. QUIGG

*Attesting Officer*

*Acting Commissioner of Patents and Trademarks*